US005681255A

United States Patent [19]

Simmons

[11] Patent Number: 5,681,255

[45] Date of Patent: Oct. 28, 1997

[54] DISPENSING TABLE AND GUIDE SYSTEM FOR A CUSHIONING CONVERSION MACHINE

[75] Inventor: James A. Simmons, Painesville Township, Ohio

[73] Assignee: Ranpak Corp., Concord Township, Ohio

[21] Appl. No.: 438,238

[22] Filed: May 9, 1995

Related U.S. Application Data

[63] Continuation-in-part of Ser. No. 155,931, Nov. 23, 1993, Pat. No. 5,487,717, which is a continuation-in-part of Ser. No. 66,337, May 21, 1993, abandoned.

[51] Int. Cl.[6] ..... B31F 1/10

[52] U.S. Cl. ..... 493/464; 493/352; 493/346; 493/407; 493/439; 493/967

[58] Field of Search ..... 493/346, 352, 493/354, 355, 356, 357, 407, 439, 464, 967; 384/17, 19, 52, 58; 312/283, 286, 287, 298, 303, 334.8, 334.9, 334.12, 334.13, 334.18–334.26, 334.33

[56] References Cited

U.S. PATENT DOCUMENTS

| | | | |
|---|---|---|---|
| 2,599,096 | 6/1952 | Dirksen . | |
| 4,076,230 | 2/1978 | Pike | 5/600 |
| 5,123,889 | 6/1992 | Armington et al. . | |
| 5,173,978 | 12/1992 | Kassai et al. | 5/600 |

FOREIGN PATENT DOCUMENTS

| | | |
|---|---|---|
| 2326271 | 10/1975 | France . |
| 90053109 | 5/1990 | Germany . |
| 9205948 | 4/1992 | WIPO . |
| 9514569 | 6/1995 | WIPO . |

*Primary Examiner*—Eileen P. Morgan

*Attorney, Agent, or Firm*—Renner, Otto, Boisselle & Sklar

[57] ABSTRACT

In combination, a cushioning conversion machine and a dispensing table, the cushioning conversion machine connected underneath the dispensing table by a guide system. The guide system includes at least one multiposition guide track connected to the dispensing table in cooperative relation with a follower connected to the cushioning conversion machine, whereby the cushioning conversion machine can be withdrawn out either the front, rear, or either side of the dispensing table.

11 Claims, 11 Drawing Sheets

DISPENSING TABLE AND GUIDE SYSTEM FOR A CUSHIONING CONVERSION MACHINE

RELATED APPLICATIONS

This application is a continuation-in-part of U.S. Pat. application No. 08/155,931 to Tekavec et al. which was filed on Nov. 23, 1993 now U.S. Pat. No. 5,487,717 and is entitled "Dispensing Table for a Cushioning Conversion Machine". The application to Tekavec et al is a continuation-in-part of U.S. patent application No. 08/066,337 Simmons et al. which was filed on May 21, 1993 now abandoned and which is entitled "Dispensing Table for a Cushioning Conversion Machine". These earlier applications are assigned to the assignee of the present invention and their entire disclosures are hereby incorporated herein by this reference.

FIELD OF THE INVENTION

The invention herein described relates generally to a dispensing table and guide system for a cushioning conversion machine. More particularly, the present invention relates to a dispensing table having a guide system which guides movement of the cushioning conversion machine underneath the table's work platform. The design of the guide system allows the machine to move from underneath the work platform in a plurality of orthogonal directions with simple alterations to the configuration of the guide system.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and renewable; making it an environmentally responsible choice for conscientious companies.

While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in commonly assigned U.S. Pat. No. 5,123,889. The therein disclosed cushioning conversion machine converts sheet-like stock material, such as paper in multi-ply form, into relatively low density pads. Specifically, the machine converts this stock material into a continuous unconnected strip having lateral pillow-like portions separated by a thin central band. This strip is coined along its central band to form a coined strip which is cut into sections, or pads, of a desired length. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

As shown in U.S. patent application Nos. 08/109,124 and 08/155,931, a cushioning conversion machine may be situated below the work platform of a dispensing table. In such an arrangement, the final outlet of the machine (i.e., the exit opening of the machine from which dunnage product is dispensed, could be aligned with an opening in the table's work platform. In this manner, the cushioning product, or pad, would be deposited on the work platform during operation of the machine. Consequently, a packaging person could conveniently grab the pad and place it in a shipping box to fill any voids and/or to cushion an item in the shipping box.

To facilitate loading and/or maintenance of the machine, provision has been made for allowing the machine to be moved from underneath the table, an example of this being shown in U.S. patent application No. 08/155,931. Depending on a given application, the machine may have to be withdrawn from the side, front or rear of the table. Heretofore, separate systems were devised for these different applications, with a corresponding number of parts lists and assembly procedures.

SUMMARY OF THE INVENTION

The present invention provides a universal guide system for a cushioning conversion machine that may be arranged in any one of a plurality of different configurations to provide for guided movement of the machine from beneath a work platform of a dispensing table in a respective one of a plurality of different withdrawal directions. The guide system of the invention reduces the number of parts needed to provide for withdrawal of the machine from the side, front and back of the machine, thus reducing or eliminating the need to custom engineer a guide system for a given application. The present invention provides substantial flexibility in locating and orienting the machine-table combination to meet the requirements of different packaging applications.

According to one aspect of the present invention, a cushioning conversion machine is connected underneath a dispensing table by a guide system that can be assembled beneath the work platform of the table at any one of plural different mounting positions for front, rear or side withdrawal of the machine from beneath the table, as may be desired for loading or servicing the machine. A preferred guide system includes at least one multiposition guide track preferably mounted to the dispensing table for cooperative interaction with a follower preferably mounted to the cushioning conversion machine, whereby the cushioning conversion machine can be withdrawn out either the front, rear, or either side of the dispensing table.

In a preferred embodiment, the different mounting positions of the guide track and/or follower are such that the conversion machine can be moved in respective alternative directions parallel to longitudinal and transverse axes of the dispensing table. In association therewith, the conversion machine is provided with a plurality of casters that can be fixedly oriented to permit the cushioning conversion machine to move in a direction parallel to a longitudinal axis of the dispensing table or in a direction perpendicular to a longitudinal axis of said dispensing table. Preferably, the casters are secured to the lower ends of machine supports that are vertically adjustable. The supports also are configured to provide for changing the orientation of the casters in a simple and easy manner, while also providing for the aforesaid vertical adjustment.

According to another aspect of the invention, a cushioning conversion machine is provided in combination with a dispensing table that includes a plurality of vertically adjustable supports, at least two of which are spaced apart a distance greater than the length of the cushioning conversion machine and at least two of which are spaced apart a distance greater than a width of the cushioning conversion machine.

According to a further aspect of the present invention, a preferred guide system comprises a guide track connected to a bottom surface of the dispensing table above the cushioning conversion machine and a follower that includes a pair of intersecting paths each adopted to receive the guide track.

The foregoing and other features of the invention are hereinafter fully described and particularly pointed out in the claims, the following description and the annexed drawings setting forth in detail a certain illustrative embodiment of the invention, this being indicative, however, of but one of the various ways in which, the principles of the invention may be employed.

DETAILED DESCRIPTION

Figure 1A:
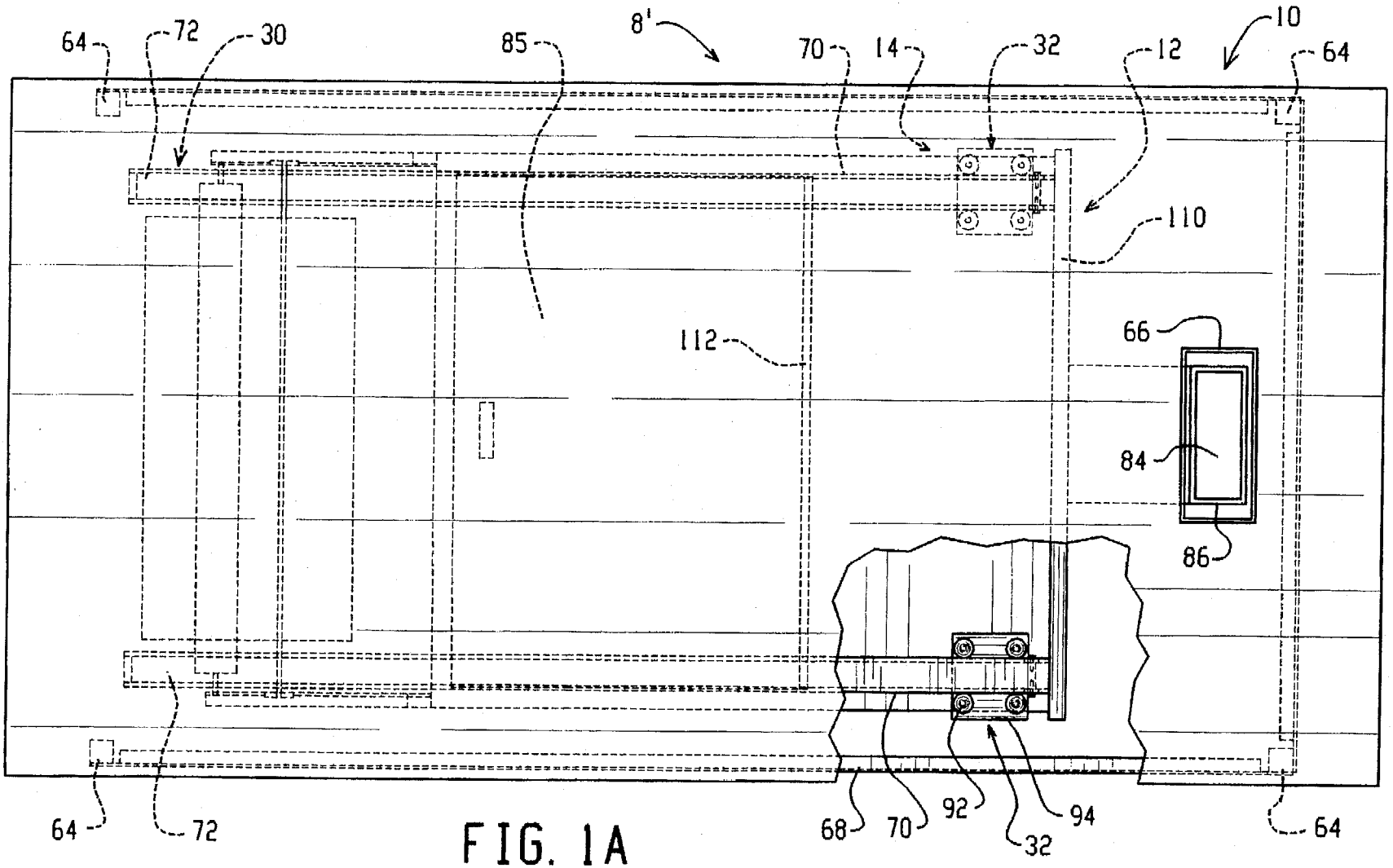
FIG. 1A is a plan view of a dispensing table-cushioning conversion machine combination according to the present invention, the combination including a dispensing table and a cushioning conversion machine guided therebeneath for movement between the illustrated operating position of the machine and a side withdrawn or pulled-out position.

Referring now to the drawings and initially to FIGS. 1–4, an embodiment of a table-machine combination 8 according to the present invention is shown. The combination 8 includes a dispensing table 10 and a cushioning conversion machine 12 which is connected to the table 10 by a guide system 14 for movement between an operating position beneath the table and a withdrawn or pulled-out position that may facilitate loading and/or servicing of the machine. FIGS. 1 and 2 show one configuration 8' of the table-machine combination for side withdrawal of the machine from beneath the table, and FIGS. 3 and 4 show another configuration 8' for front (or rear) withdrawal of the machine.

As shown in FIGS. 1–4, the cushioning conversion machine 12 has an upper housing 16 which houses various conversion assemblies (as discussed below in connection with FIG. 7) that convert stock material, such as multi-ply kraft paper, into a dunnage product. The housing 16 is supported on a cart 18 including a plurality of vertical support members or legs 20. The support members 20 each include a caster 22 at its lower end to permit the machine 12 to move with relative ease only in a direction perpendicular to the rotation axis of the caster wheel. The casters 22 (or more particularly the wheels thereof) can be oriented, as in the manner hereinafter described, to permit the machine 12 to move in a direction parallel to a longitudinal axis of the table 10 (FIGS. 1 and 2) or to permit the machine 12 to move in a direction perpendicular to the longitudinal axis (FIGS. 3 and 4).

The guide system 14 illustrated in FIGS. 1–4 can also be disposed in alternative configurations to permit movement of the machine parallel to or perpendicular to the longitudinal axis of the table. The guide system 14 includes guide tracks 30 and followers 32. The guide tracks 30 can be arranged parallel to the longitudinal axis of the table 10 (FIGS. 1 and 2) allowing movement of the machine out the side of the table. Alternatively, the tracks 30 can be rotated 90 degrees to provide for movement of the machine out the front (or rear) of the table (FIGS. 3 and 4).

Figure 1B:
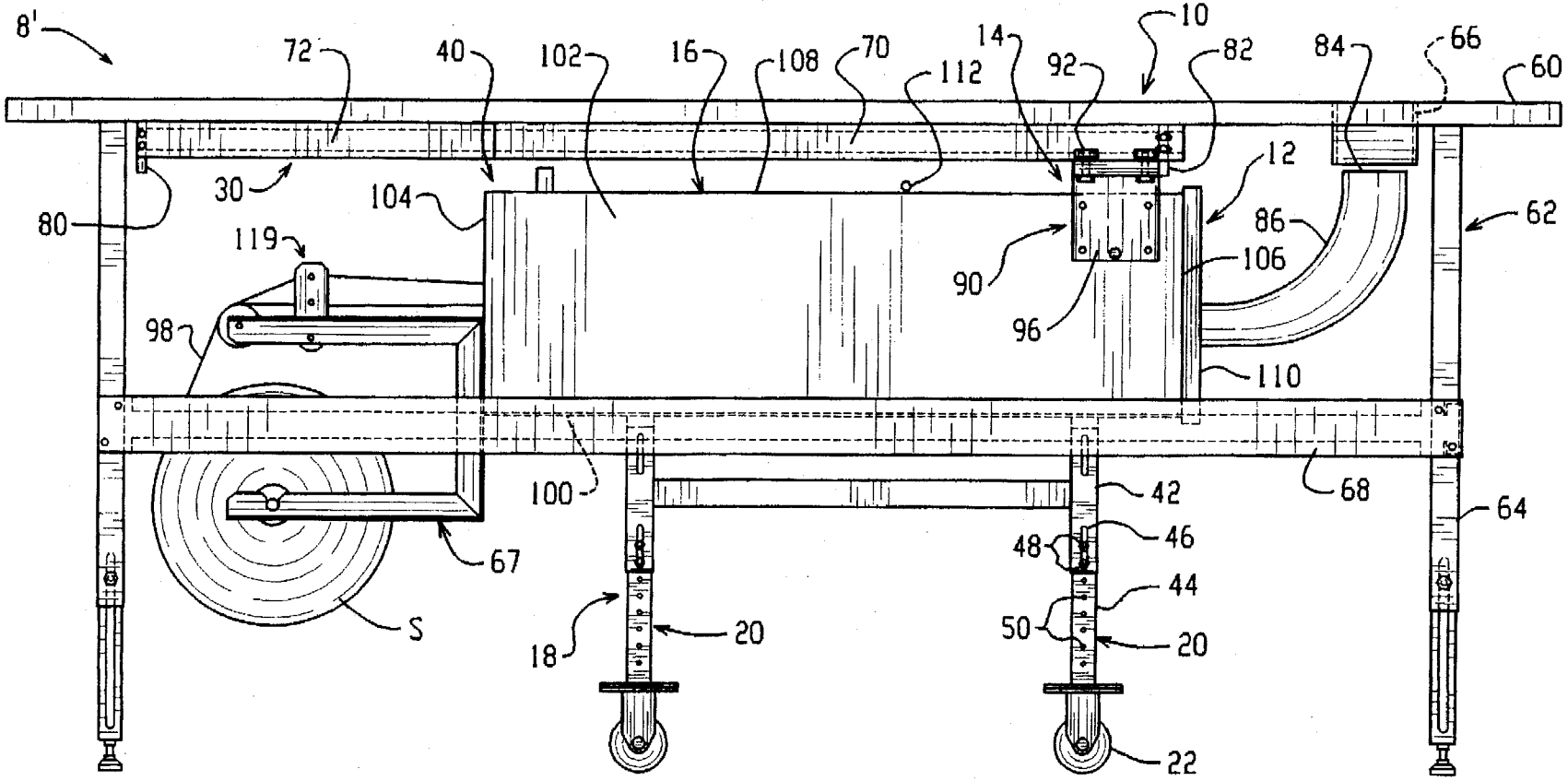
FIG. 1B is a front elevational view of the table-machine combination shown in FIG. 1A.

Focussing now on FIGS. 1A and 1B, the support members 20 form four vertical legs of the cart 18. Preferably, the support members 20 are constructed from square, tubular steel, and include a fixed upper portion 42 and a telescoping lower portion 44 which moves in and out of the interior of the fixed portion 42. Each upper portion 42 includes a vertical slot 46 which is designed to receive a removable lock or latch device 48, such as one or more bolts. Each lower portion 44 includes a plurality of holes 50 for selective receipt of the bolt or bolts 48 to fix the lower portion 44 in relation to the upper portion 42 at a selected extension length, whereby the vertical height of the housing 16 may be adjusted. The holes 50 in the lower portion provide for rough incremental adjustment of the length of the legs 20 while the vertical slots 46 in the upper portions of the legs provide infinite fine adjustment of the length of the legs over a limited range. This is advantageous for proper leveling of the machine even when the underlying floor is not level. The lower portion 44 of each leg 20 preferably has a close sliding fit in the upper portion 42 to provide a stable support for the conversion assemblies housed in or mounted to the housing 16. Also, the square cross-sections of the upper and lower portions cooperate to prevent relative rotation therebetween when telescoped together. Being square, the lower portion can be inserted into the upper portion at 90 rotated positions for allowing selection of the position of the casters between one with the wheel axis oriented perpendicular to the longitudinal axis of the table (FIGS. 1 and 2) and one with the wheel axis oriented perpendicular to the transverse axis of the table (FIGS. 3 and 4). It will be appreciated, however, that other arrangements may be provided to fix the orientation of the caster wheels at one of plural directions, such as by use of the bolts and holes alone which are cooperative to hold the lower leg portion at either one of two angularly rotated positions. Each side of the lower portion is provided with a row of holes aligned with the holes in the opposite side to permit such rotated adjustment.

The dispensing table 10 comprises a horizontal work platform or table top 60 supported on a rectangular frame 62. The work platform 60 may be approximately 83 wide and 42 inches deep, for example. The work platform has an opening 66 through which (when the machine 12 is slid to the operating position and is operating) cushioning products, or pads, are discharged for easy access by a packaging person who may grab the dispensed pad (or other dunnage product and) place the pad in a shipping box supported on the work platform to fill any voids and/or to cushion an item in the box.

The table frame 62 includes four vertical legs 64 which are telescopically adjustable to position the work platform 60 at a convenient height for a worker performing packaging duties. Preferably, the table will have a maximum height of approximately 3 feet, with each leg having a range of adjustment of approximately 7 inches. Thus, the height of the table top 10 may range from approximately 29 inches to approximately 36 inches.

Figure 3A:
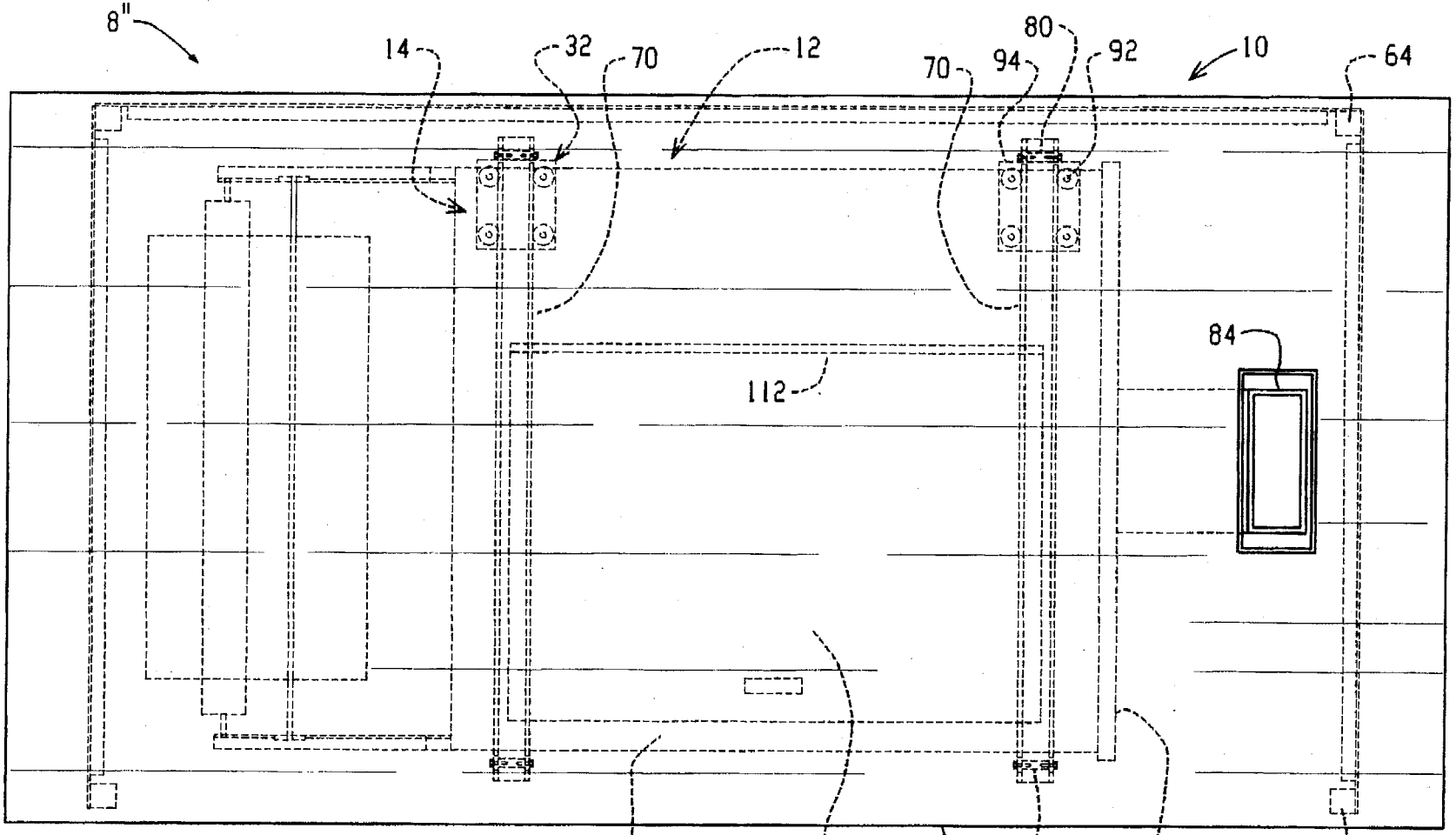
FIG. 3A is a top view of an alternative configuration of the table-machine combination according to the present invention, the machine being guided for transverse movement between the illustrated operating position and a front withdrawn position.
Figure 3B:
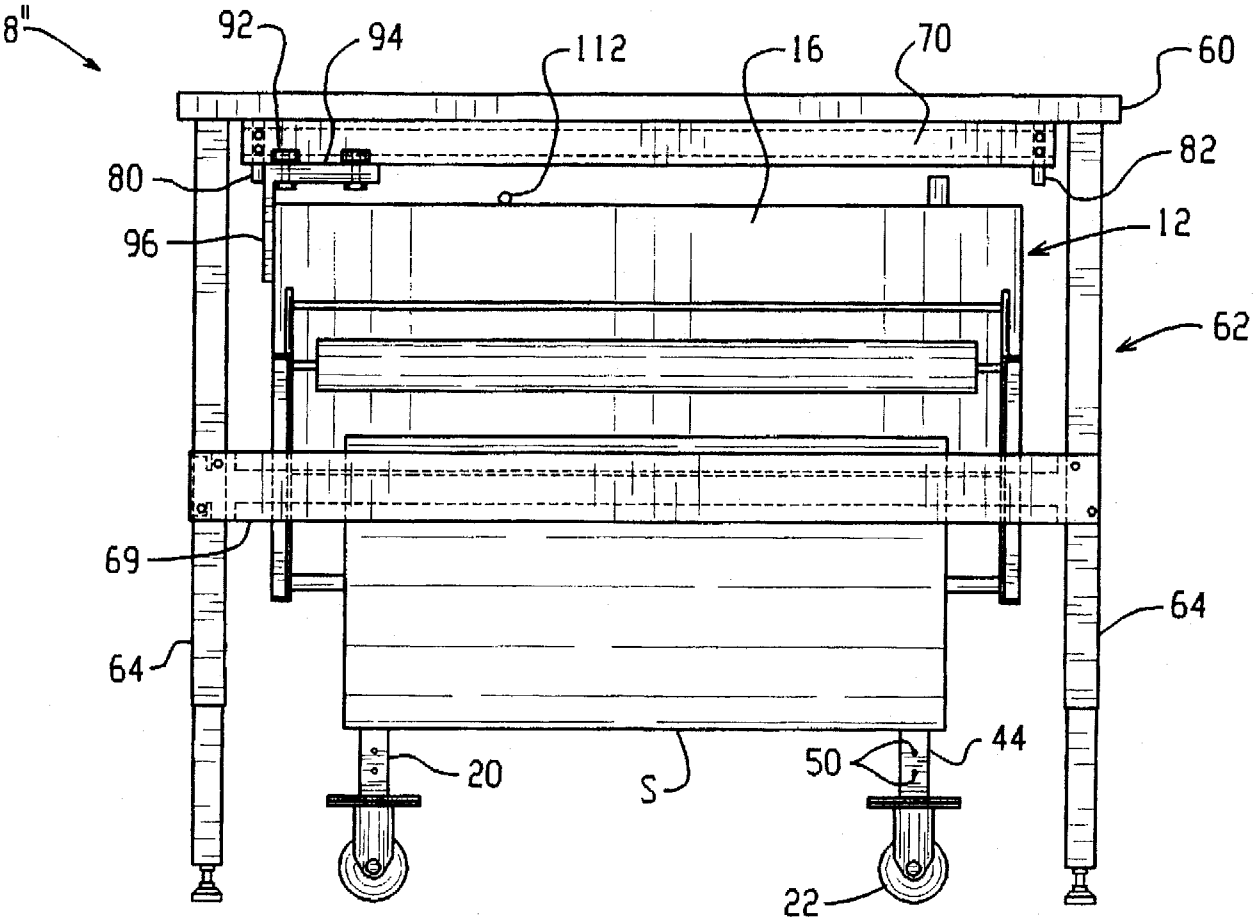
FIG. 3B is an end elevational view of the table-machine combination shown in FIG. 3A.

The vertical support members or legs 64 are preferably located at each corner of the work platform 60. The longitudinal spacing between the legs at the front and rear of the table is preferably greater than the length of the entire cushioning conversion machine, including a stock roll S supported on a stock role holder 67 mounted to the housing 16 of the machine 12. This spacing of the legs will permit the machine to be removed from underneath the table out either the front or back of the table. Furthermore, the spacing between the front and rear legs at each side of the table is greater than the overall width of the machine, as best illustrated in FIG. 3B. This spacing permits the machine to be moved from underneath the table out either side of the table.

The table frame 62 further includes horizontal frame members or braces 68 and 69 extending between relatively adjacent legs. In view of the rectangular configuration of the frame, the braces 68 extending between the legs 64 at the front and rear of the table are longer than the braces extending between the legs at the sides of the table. Preferably, the respective long and short braces are identical and interchangeable with one another, i.e., front-to-back or side-to-side. The braces are removably attached by suitable fastening means such as fasteners, latching devices, hooks, etc. Of course, one of the illustrated braces will be removed to permit withdrawal of the machine at the corresponding end of the table, be it the front, rear or a side of the table. Moreover, a single long and single short brace should be sufficient for most applications.

The dispensing table 10 has guide system 14 assembled with respect thereto. The guide system 14, as shown in FIGS. 1A and 1B, includes one or more parallel guide tracks 30 at the underside of the work platform 60 and respective followers 32 for guided movement of the machine 12. Preferably the guide tracks are secured to the table and the followers to the machine. The followers are arranged one for each tract and are secured to the machine at its trailing end taken in relation to the direction that the machine is withdrawn from the table. In the illustrated embodiment, two followers are provided at respective corners of the machine.

In the FIGS. 1A and 1B configurations, there are front and rear guide tracts 30 each including a guide rail 72 and a guide rail extension 72. In this embodiment, the main guide rail 70 and guide rail extension 72 are channel members which are attached at the base of the channel to the bottom surface of the work platform 60 by suitable fastening means such as screws, bolts, clips; adhesives, etc. Preferably, the rails are removably secured to the table for easy reconfiguring of the table-machine for a different use as may be desired. However, the rails may be more permanently fixed in place for a given application.

Figure 2A:
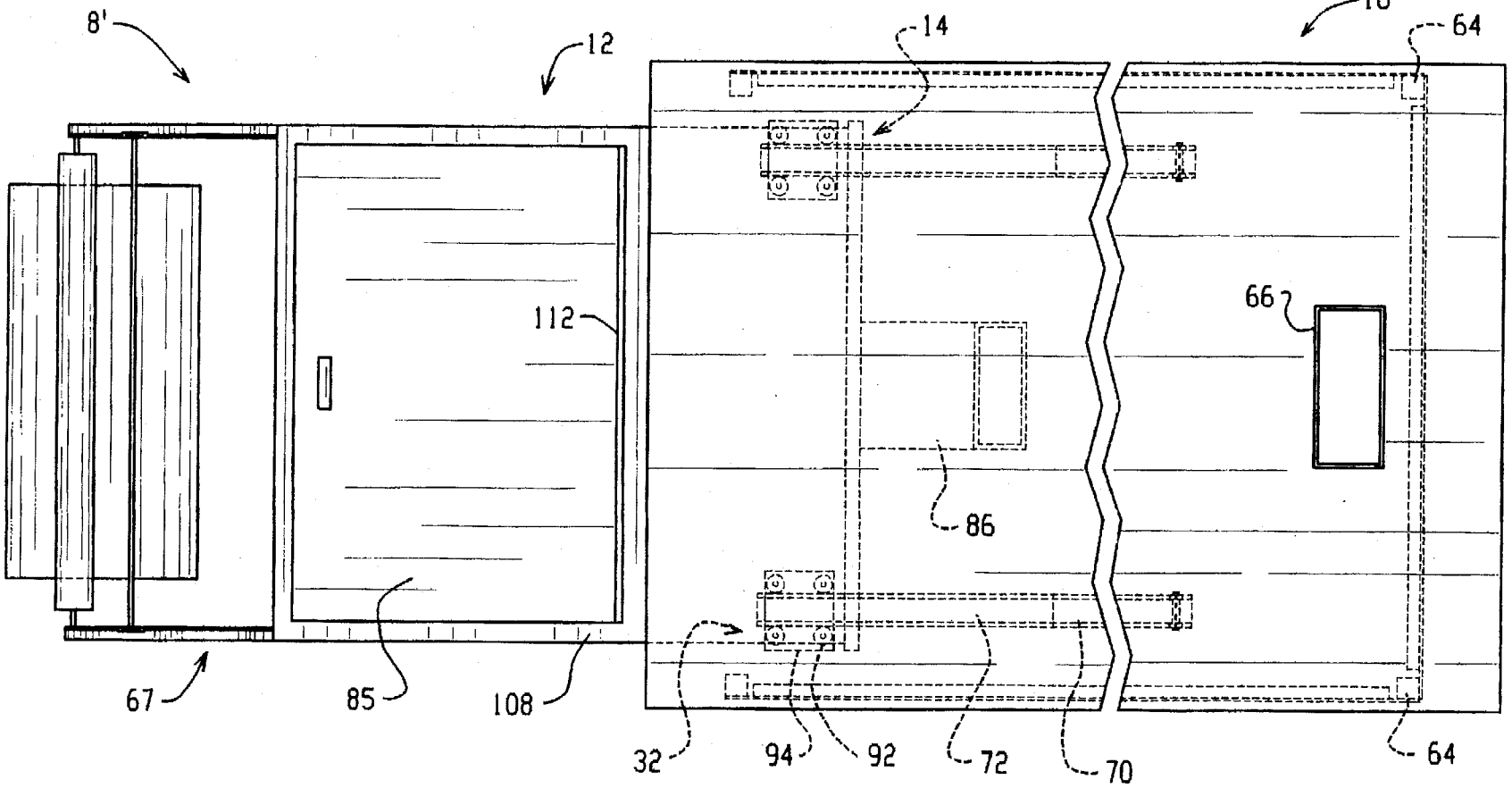
FIG. 2A is a fragmentary plan view of the table-machine combination of FIG. 1A, showing the machine withdrawn from one side of the table.
Figure 2B:
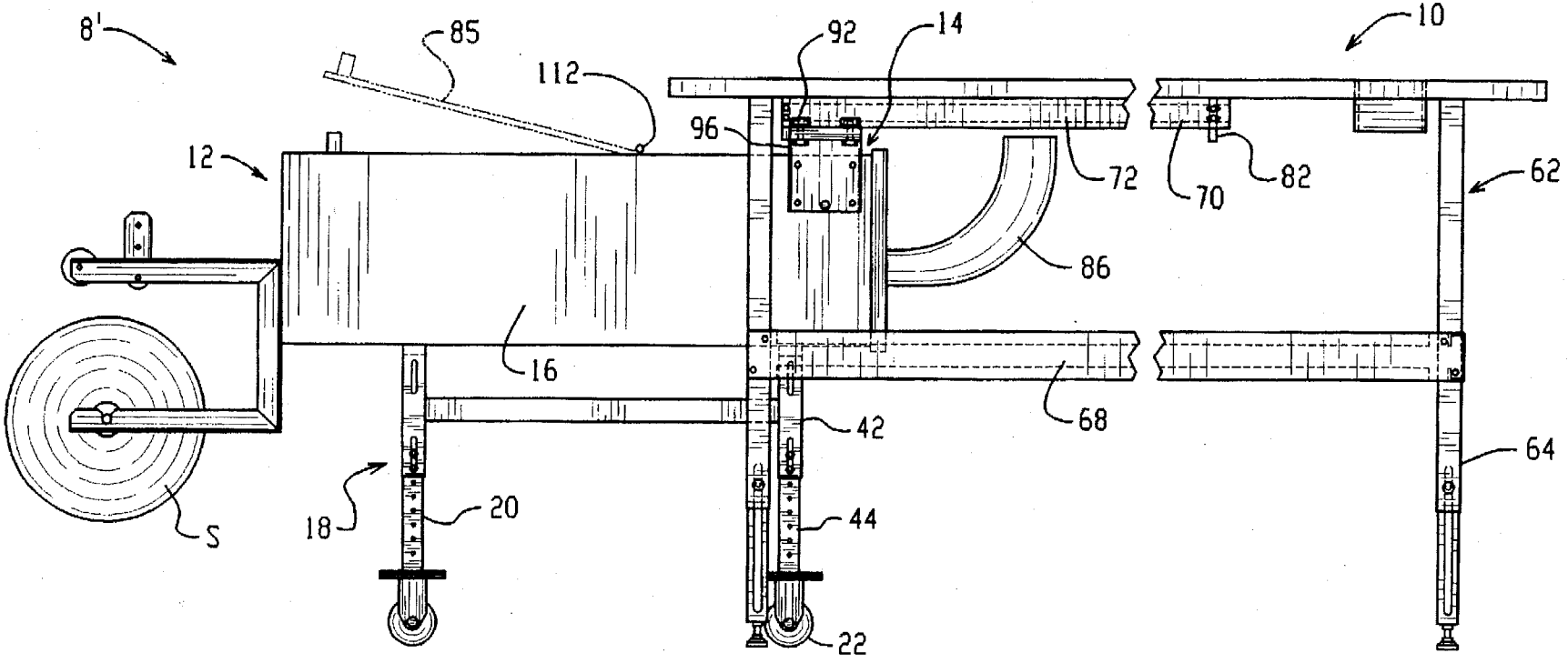
FIG. 2B is a fragmentary front elevational view of the table-machine combination in its position shown in FIG. 2A.

The pair of guide tracks are parallel to one another and run lengthwise on the table 10 in FIGS. 1 and 2. This orientation of the guide tracks permits the machine 12 to be pulled out the side of the table 10. (See FIGS. 2A and 2B.)

Preferably, the guide rails 70 (separate from the rail extensions 72) are shorter than the width of table 10, such that in the alternative configuration of the table-machine combination shown in FIGS. 3 and 4, the guide rails 70 can be rotated 90 degrees and still fit within the width of the work platform 60 without projecting forwardly or rearwardly therefrom.

Stops 80 and 82 are provided at opposite ends of the guide tracks 30. Stops 80 are located to limit the extent of side withdrawal of the machine 12 and to prevent the follower 32 from running off the guide track. Stops 82 are located to provide a positive stop for aligning an exit opening 84 of a post-cutting constraining assembly 86 of the machine 12 with the opening 66 in the work platform 60. In the illustrated embodiment, the stops are engaged by the followers 32, but they could be positioned to interfere with any portion of the machine. As a further modification, the stops (or stop), or other obstruction may be positioned elsewhere on the table to interfere and limit movement of the machine in one or both directions.

The overall configuration of the guide tracks 30, followers 32 and casters 22 illustrated in FIGS. 1A and 1B permits the machine 12 to move parallel to the longitudinal axis of the table and thus out a side of table 10 as illustrated in FIGS. 2A and 2B. In this withdrawn position, the machine 12 can be easily loaded with stock material as the stock roll holder is then easily accessible for loading a stock roll thereon. Also, an access door 85 in the top of the machine housing may be accessed and opened for feeding the end of a new roll of stock material through the machine. Furthermore, maintenance on internal components of the conversion assemblies can be easily performed.

FIGS. 3 and 4 illustrate an alternative configuration of the table 10 and machine 12 which will permit the machine to move perpendicular to the longitudinal axis of the table. In this configuration, the guide rail extensions 72 are not used and the guide rails 70 are secured to the underside of the table top 60 parallel to the transverse axis of the table (as discussed previously, the length of guide rails 70 is less than the depth of the table 10). Additionally, the lower portions 44 of the legs 20 are rotated 90 degrees, such that the casters 22 are oriented to permit movement of the machine perpendicular to the longitudinal axis of the table.

Figure 4A:
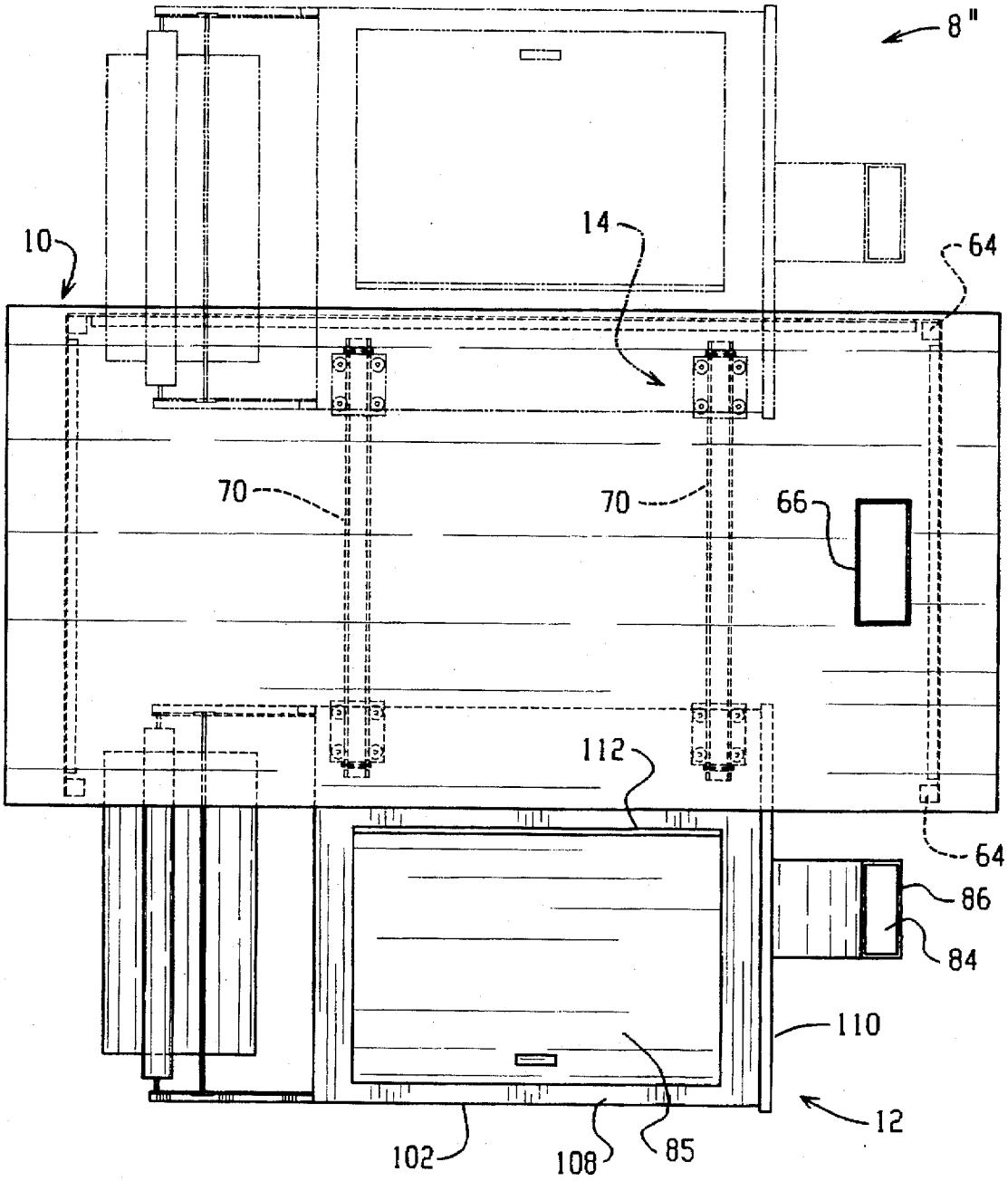
FIG. 4A is a fragmentary plan view of the table/machine combination shown in FIG. 3A illustrating the machine pulled out to the front of the table in solid and the machine pulled out (alternatively) to the back of the table in phantom.
Figure 4B:
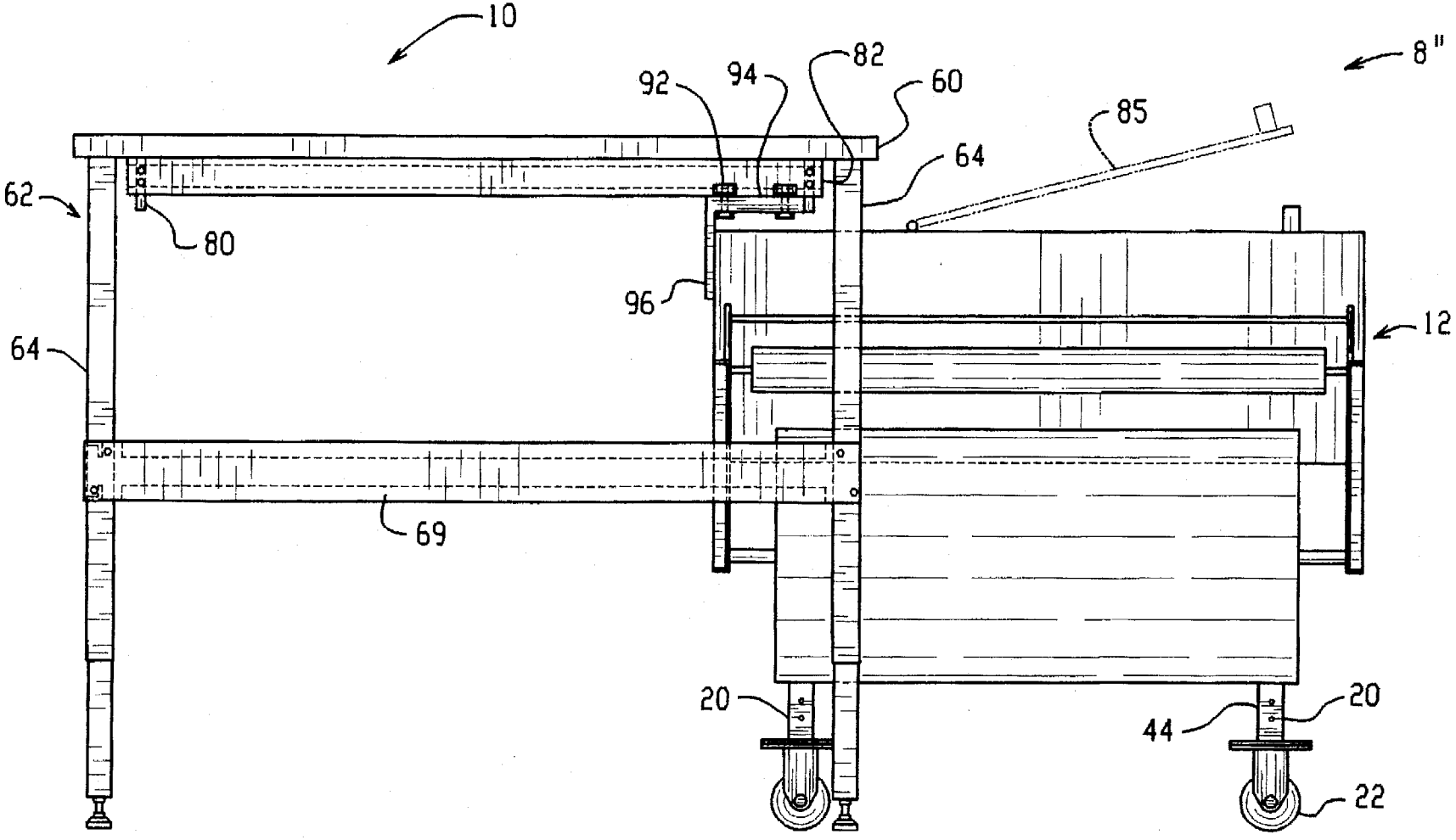
FIG. 4B is a side elevational view of the table-machine combination shown in FIG. 4A.

As before, the followers 32 engage the guide rails 70 to guide the machine 12 out the front (or back) of the table 10, as illustrated in FIGS. 4A and 4B. As when the machine was guided out the side of the table 10, it can now be loaded with stock material and/or have maintenance performed thereon with relative ease.

Figure 5A:
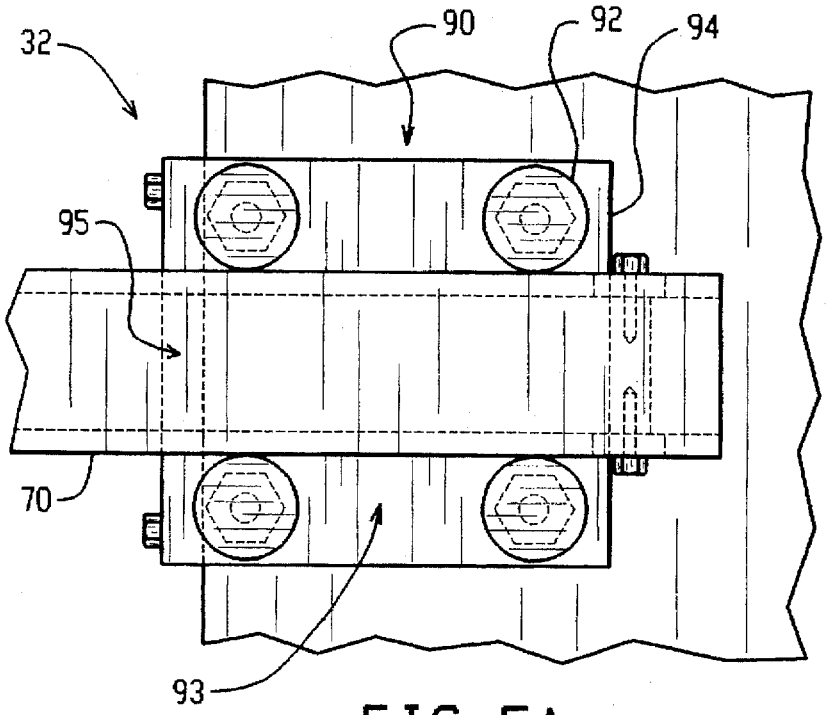
FIG. 5A is an enlarged plan view of an exemplary guide assembly.
Figure 5B:
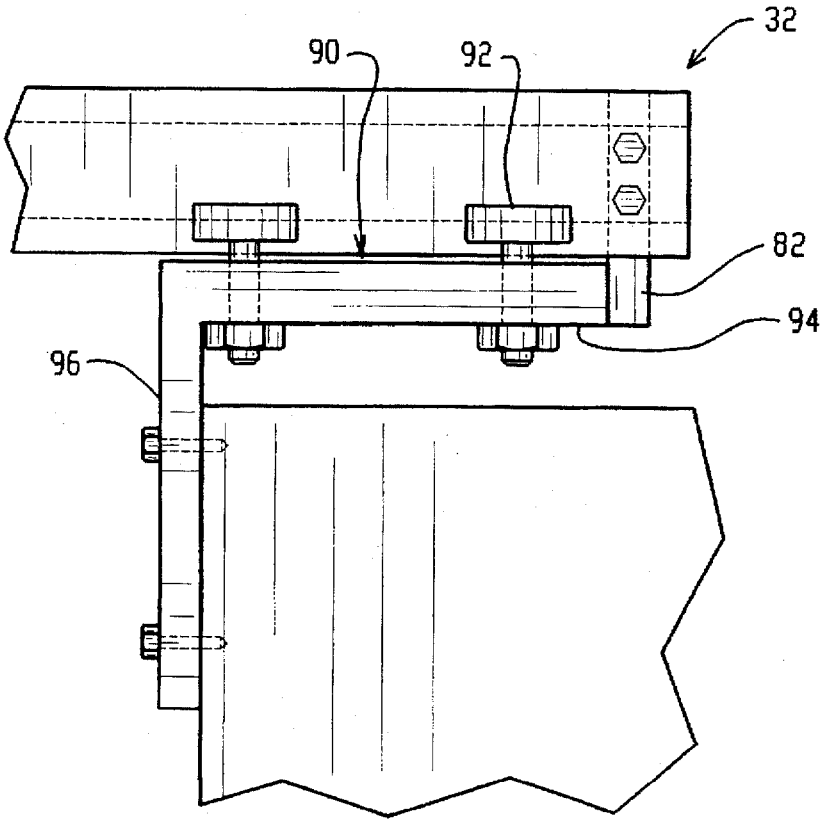
FIG. 5B is a side view of the guide assembly shown in FIG. 5A.

Referring now to FIGS. 5A and 5B, the followers 32 preferably are identical and interchangeable, each including a mounting bracket 90 and rollers 92. The mounting bracket 90 is generally L-shape with the rollers 92 mounted to one leg 94 and the other leg 96 being adapted for attachment to the machine housing 16, as by any suitable fastening means. Preferably, the follower is removably secured to the machine housing for easy adaptability to different configurations, such as that shown in FIGS. 1 and 2 on the one hand and FIGS. 3 and 4 on the other hand.

The rollers 92 are rotatably mounted to leg member 94 and arranged so to engage the sides of the respective guide rail 70. The rollers 92 are symmetrically arranged to create a pair of intersecting paths for receiving the guide rail, one path being used when the guide rail extends parallel to the longitudinal axis of the table and the other being used when the guide rail extends perpendicular to the longitudinal axis. Preferably, the rollers 92 are disposed at the four corners of an imaginary square such that the axes of the two paths 93 and 95 are perpendicular to one another for the above indicated usage. As seen in FIG. 5B, the stop 82 is positioned on the guide rail and projects therebeneath to engage the end of the leg 94 of the bracket 90.

Figure 6:
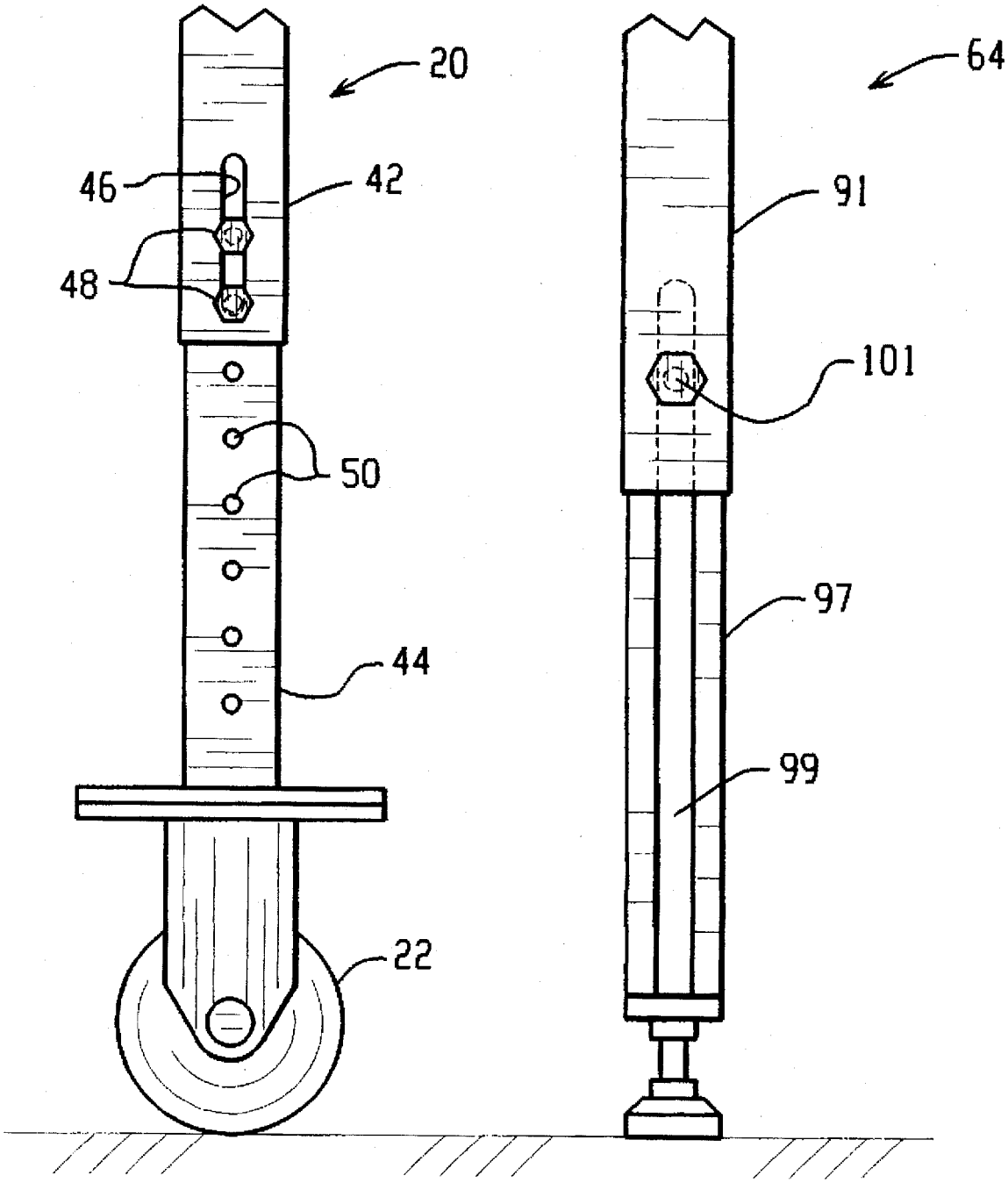
FIG. 6 is an enlarged fragmentary elevational view illustrating an exemplary leg of the table and exemplary leg support of the machine.

FIG. 6 further illustrates the legs 64 of the table 10 and legs 20 of the machine 12. As previously mentioned, the legs 20 of the machine 12 are vertically adjustable and provide for rotation of the casters between two orientations. The legs 20 of the preferred embodiment have a pair of hex-bolts which pass through the slot 46 and holes 50. The hex-bolts cooperate with nuts (not shown) located on the opposite side of the support member for tightening into engagement with the upper leg portion, thereby fixing the height of the machine 12.

The legs 64 of the table 10 are also vertically adjustable. The legs 64 each have a fixed upper portion 91 and a telescoping lower portion 97. Unlike the legs 20, the lower portion 97 does not have a plurality of holes, but rather has a vertically extending slot 99 which receives a lock bolt 101. The lock bolt cooperates with a nut to secure the position of the lower portion relative to the upper portion of the leg.

Referring back to FIGS. 1A and 1B, the cushioning conversion machine 12 is shown loaded with a roll S of sheet-like stock material 98. The stock material may consist of three superimposed webs of biodegradable, recyclable and reusable paper rolled onto a hollow cylindrical tube. The machine 12 converts the stock material into a continuous unconnected strip having lateral pillow-like portions separated by a thin central band. This strip is coined along its central band to form a coined strip which is cut into sections, or pads, of a desired length.

The housing 16 of the cushioning conversion machine 10 includes a frame 40 having a base plate 100, a pair of lateral side plates 102, an upstream end plate 104, a downstream end plate 106, a top plate 108, and back door 110. Because the machine 12 is positioned in a substantially horizontal manner, the imaginary longitudinal axis of the machine from its upstream end to its downstream end is substantially horizontal.

The base plate 100 and the side plates 102 are essentially solid rectangular sheets. The end plates 104 and 106 are also rectangular, however they are not solid. Instead, the upstream end plate 104 includes a large inlet opening which essentially results in the plate 104 resembling a border, rather than a plate. The downstream end plate 106 includes a relatively small outlet opening.

The top plate 108 has the access door or top cover 85 attached thereto by a hinge 112 for opening and closing an access opening in the top plate. The hinged top cover 85 allows access to the internal conversion assemblies for necessary maintenance and feeding of paper during loading. The hinge 112 may be disposed along any one of the four edges of the top cover 108 depending upon the direction of withdrawal movement of the machine relative to the table 12. For example, if the machine 12 and table 10 were configured such that the machine 12 moved parallel to the longitudinal axis of the table and out the side of table, the hinge 112 would be disposed along the edge of the top cover 85 closest the downstream end plate 106, or possibly the upstream end plate 104. Alternatively, if the machine were configured as shown in FIGS. 3A and 3B, i.e., configured such that the machine 12 moved perpendicular to the longitudinal axis, the hinge 112 would be disposed along the edge of the top cover 85 which is closest either of the lateral side plates 102, depending upon which direction (backwards or forwards) the machine 12 was to be moved. Generally, the hinge 112 is disposed along the edge of the top cover 85 which exits the table last, e.g., if the machine moves in an upstream direction (i.e., to the position in FIG. 2A), the hinge is located on the edge of the top cover closest the downstream end plate.

In operation of the machine 12, stock material is fed through the machine and converted into a cushioning product. The cushioning product is then cut into sections or pads and these cut sections then travel through the post-cutting constraining assembly 86.

In the preferred machine 12, the post-cutting constraining assembly 86 extends outwardly from the back plate 110 and its overall geometry approximates a generally 90 degree curved arc. The exit opening 84 of the post-cutting constraining assembly 86 is the final outlet of the machine 12 as the cushioning product emerges through this outlet during operation of the machine.

When the machine 12 is positioned in the operating position, its final outlet 84 is aligned with the table's opening 66 whereby the pads will be deposited on the work platform 60. One may appreciate that the above described table-machine combination is beneficial even if only used in connection with the operating position thereof because it allows for easy alignment of the machine's final outlet 84 and the table's opening 66. Moreover, the table 10 may be modified to include multiple dispensing openings and the table-machine combination would allow a packaging person to select a desired dispensing opening.

Figure 7:
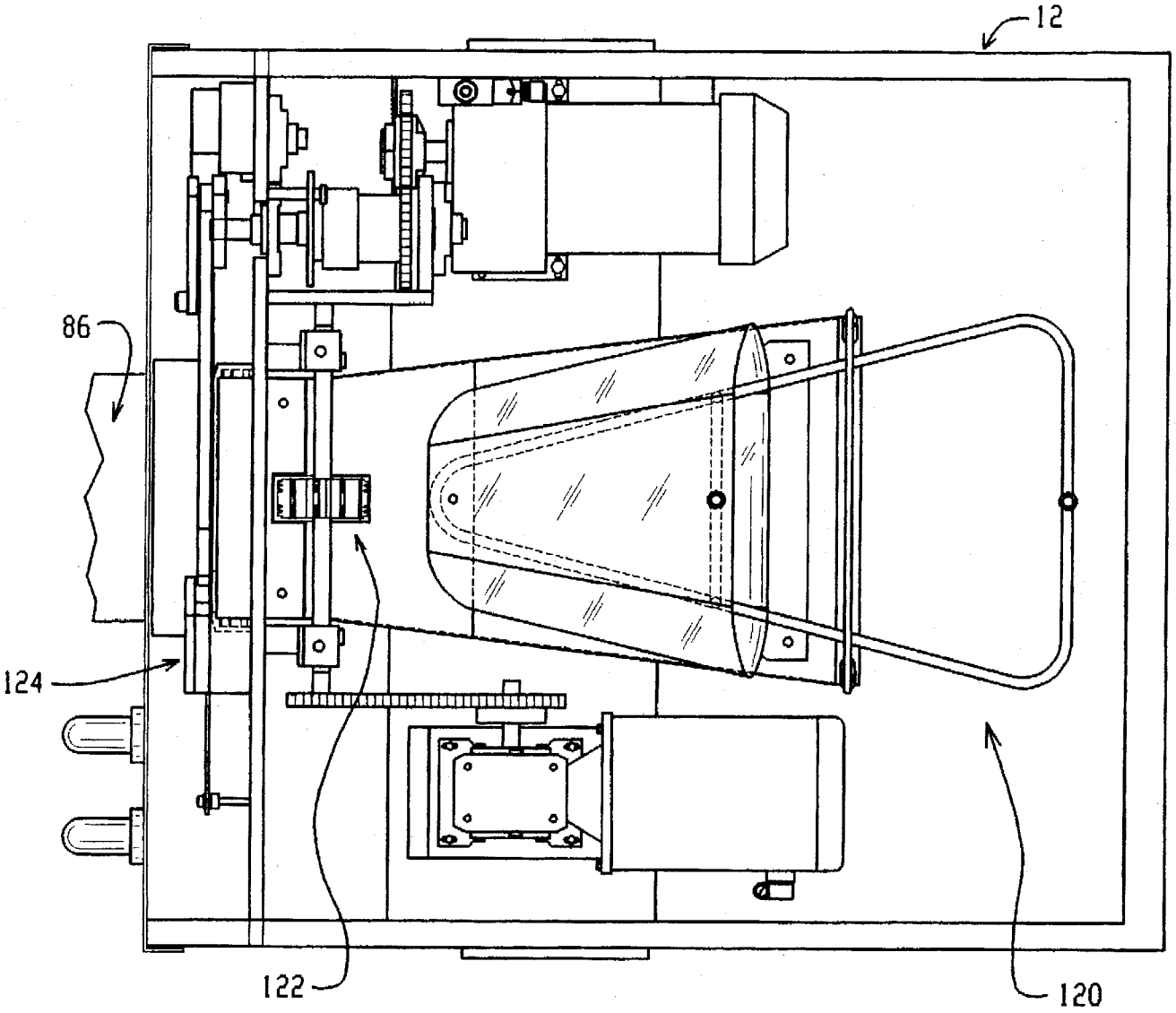
FIG. 7 is a plan view showing internal components of an exemplary cushioning conversion machine useful in practicing the present invention.

FIG. 7 generally illustrates the internal conversion assembles of a preferred cushioning conversion machine such as that shown in U.S. Pat. No 5,123,889 to which reference may be had for further details. The machine 12 includes a separating assembly 119 (FIG. 1B), a forming assembly 120, a feed gear assembly 122, a cutting assembly 124, and the post-cutting constraining assembly 86. The general operation of these assemblies is described in detail in U.S. Pat. No. 5,123,889.

One may now appreciate that the table/machine combination of the present invention allows for convenient loading of stock material, easy threading of stock material, and/or handy maintenance of certain components of the machine. Furthermore, one skilled in the art will appreciate that the table/machine combination of the present invention will reduce the need for custom engineering to meet individual needs through the use of a guide system which can be oriented to permit removal of the machine out the front, back or side of the table.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

I claim:

1. In combination, a dispensing table and a cushioning conversion machine connected underneath said dispensing table by a guide said dispensing table having longitudinal and transverse axes with respective ends and sides; and said guide system including at least one multiposition guide track member selectively connected to said dispensing table at one of at least two alternate positions respectively parallel to said longitudinal and transverse axes; and a follower on said cushioning conversion machine cooperative with said guide track for guiding movement of said machine parallel to said guide track, whereby said cushioning conversion machine can be withdrawn from a selected one of plural different ends or sides of said dispensing table without changing the orientation of the machine.

2. The combination of claim 1, wherein said dispensing table has a table top having a length along its longitudinal axis greater than its length along its transverse axis, and further comprising a guide track extension member on said dispensing table for forming an extension of said guide track member at the alternate position thereof parallel to said longitudinal axis.

3. The combination of claim 2, wherein said guide track member is a guide rail mountable to the underside of said table top at either of said alternate positions thereof, and said guide track extension member is a guide rail extension mountable to the underside of said table to form a continuation of said guide rail when mounted at the alternate position thereof parallel to the longitudinal axis of said dispensing table.

4. The combination of claim 1, wherein said dispensing table has a table top, and said guide track member is a guide rail mountable to the underside of said table top at either of said alternate positions thereof.

5. The combination of claim 1, wherein said machine includes at least one wheel for supporting said machine for movement along a floor, and said one wheel is adjustable between two fixed angularly rotated positions respectively positioning the rotation axis of said one wheel parallel to said longitudinal and transverse axes of said dispensing table.

6. The combination of claim 5, wherein said machine includes at least one support leg, and said wheel is mounted at the lower end of said support leg.

7. The combination of claim 6, wherein said one support leg is vertically adjustable in length.

8. The combination of claim 1, wherein said dispensing table includes a plurality of support legs, at least two of which are spaced apart a distance greater than a length of said cushioning conversion machine and at least two of which are spaced apart a distance greater than a width of said cushioning conversion machine.

9. The combination of claim 8, wherein said support legs of said dispensing table are vertically adjustable in length.

10. In combination, a dispensing table and a cushioning conversion machine connected underneath said dispensing table by a guide system;

said dispensing table having longitudinal and transverse axes with respective ends and sides;

said guide system including at least one multiposition guide track member on said dispensing table at one of at least two alternate positions respectively parallel to said longitudinal and transverse axes, and a follower on said cushioning conversion machine cooperative with said guide track for guiding movement of said machine parallel to said guide track, whereby said cushioning conversion machine can be withdrawn from a selected one of plural different ends or sides of said dispensing table without changing the orientation of the machine; and said follower including a pair of guideways intersecting which receive said guide track respectively in said two alternate positions thereof.

11. In combination, a dispensing table and a cushioning conversion machine connected underneath said dispensing table by a guide system; said guide system including at least one guide track connected to said dispensing table in cooperative relation with a follower connected to said cushioning conversion machine, said one guide track being connected to said dispensing table at one of at least two alternate positions, and said follower including a pair of intersecting guideways which receive said guide track respectively in said two alternate positions of said guide track for withdrawing the machine from different ends or sides of the table.

* * * * *

UNITED STATES PATENT AND TRADEMARK OFFICE

CERTIFICATE OF CORRECTION

PATENT NO. : 5,681,255

DATED : October 28, 1997

INVENTOR(S) : James A. Simmons

It is certified that error appears in the above-identified patent and that said Letters Patent is hereby corrected as shown below:

In claim 1, column 9, line 10, "guide" should be --guide system--.

In claim 10, column 10, line 32, "guideways intersecting" should be --intersecting guideways --.

Signed and Sealed this

Thirty-first Day of March, 1998

*Attest:*

BRUCE LEHMAN

*Attesting Officer*

*Commissioner of Patents and Trademarks*